United States Patent [19]

Kikuchi et al.

[11] 4,127,149

[45] Nov. 28, 1978

[54] WEFT YARN GUIDE

[75] Inventors: Takeshi Kikuchi, Chofu; Shinji Mizunaga, Tokyo, both of Japan

[73] Assignee: Nissan Motor Company, Limited, Japan

[21] Appl. No.: 814,091

[22] Filed: Jul. 8, 1977

[30] Foreign Application Priority Data

Jul. 14, 1976 [JP] Japan ..... 51/92881[U]

[51] Int. Cl.[2] ..... D03D 47/31

[52] U.S. Cl. ..... 139/435

[58] Field of Search ..... 139/435

[56] References Cited

U.S. PATENT DOCUMENTS

| | | | |
|---|---|---|---|
| 3,525,369 | 8/1970 | Ugstreil et al. | 139/435 |
| 3,742,973 | 7/1973 | Kakac | 139/435 |

FOREIGN PATENT DOCUMENTS

| | | | |
|---|---|---|---|
| 2,438,754 | 2/1976 | Fed. Rep. of Germany | 139/435 |

*Primary Examiner*—Henry S. Jaudon

*Attorney, Agent, or Firm*—Robert E. Burns; Emmanuel J. Lobato; Bruce L. Adams

[57] ABSTRACT

The side surfaces of a trunk and curved portions of the weft yarn guide are so configured as to be convexly curved at the intersection of same with the confronting surfaces defining the gap between the trunk and curved portions, inboard of the widest portions of the trunk and curved portions so that the warp yarns can slidingly pass over the surface of the weft yarn guide without being made nappy or shaggy by contacting with sharp edges.

4 Claims, 8 Drawing Figures

WEFT YARN GUIDE

BACKGROUND OF THE INVENTION

1. Field of the Invention

The present invention relates to an improvement in a weft yarn guide or a weft yarn guiding member of a guiding comb for an air jet shuttleless weaving loom which is locatable in the weft yarn path during insertion and which passes the jet of air entraining the weft yarn.

2. Description of the Prior Art

As is well known in the art, a guiding comb of this type is formed of a number of guiding members arranged in alignment at suitable intervals. The guiding member 1 and therefore the guiding comb are fixedly secured to a front part of a reed 2 as shown in FIG. 1 of the accompanying drawings. The guiding member 1 includes an upright portion 3 and a curved portion 4 branched off from a middle part of the upright portion 3 and then curved toward an upper portion of the upright portion 3. The upright and curved portions 3 and 4 form therebetween a generally circular guiding aperture 5. The curved portion 4 has an end portion confronting the upper portion of the upright portion 3 and spaced from the upper portion a suitable distance so as to form therebetween a gap 6 which forms an exit for the weft yarn. The upright portion 3 projects a certain length outer than the top of the curved portion 4 in the direction of the length of the trunk portion 3. A plurality of guiding members 1 thus constructed and arranged are placed into a shed 8 of warp yarns 9 by insertion between adjacent warp yarns 9 and thus located in the weft yarn path prior to insertion. A jet of air from a main nozzle (not shown) is guided by the guiding apertures 5 and the weft yarn is inserted via the air jet which entrains same. The guiding members 1 and therefore the guiding comb are then taken out of the row of the warp yarns 9 and are located in a position shown by the phantom lines in FIG. 1 in the midst of movement of the reed 2 into its beat-up position. In the course of movement of the guiding members 1 out of the row of the warp yarns 9, the weft yarn is passed through the gap 6 of each guiding member 1 and is removed from the guiding aperture 5 under the condition in which the weft yarn is supported or caught by weft catching means (not shown) such as warp yarns.

The upright portion 10 of a conventional guiding member 11 has had a form such as one of halves of a spindle cut in two along a center line in the longitudinal direction of the spindle, as shown in FIG. 2 of the drawings. This is to facilitate the entrance of the guiding member 11 into the row of the warp yarns 9. The upright portion 10 thus formed has had an inner flat surface 12 as shown in FIG. 2 which confronts the weft yarn passed through the gap 6 outside the guiding member 11. The inner surface 12 has made an acute angle with the curved side surfaces 13 of the upright portion 10 which face planes perpendicular to the weft yarn passed through the gap 6 so that sharp corners have been formed at both edges 14 and 15 of the inner surface 12, as seen in FIG. 2. As a result, the conventional guiding member 11 has suffered from the drawback that, when it is put into and taken out of the row of the warp yarns 9 and the upright portion 10 comes in contact with the warp yarns 9, the warp yarns 9 are rubbed by the sharp corners of the edges 14 and 15 and are made nappy or rough. Especially, when the guiding member 11 is taken out of the row of the warp yarns 9, since the sharp corners of the edges 14 and 15 of a portion of the inner surface 12 projecting outer than the curved portion 16 first of all come into contact with the warp yarns 9, nap of the warp yarns 9 has been promoted.

Furthermore, since the conventional guiding member 11 has been peaked at the top 17 of the upright portion 10, when the guiding member 11 has been inserted into the row of the warp yarns 9, the peaked top 17 has struck against same and made them nappy or shaggy.

SUMMARY OF THE INVENTION

It is, therefore, an object of the invention to provide a weft yarn guide for an air jet shuttleless weaving loom which is improved so that, when the weft yarn guide is inserted into and taken out of the row of warp yarns, the warp yarns are prevented from being made nappy by the weft yarn guide.

This object is accomplished by forming at the top of the upright portion of the weft yarn guide a gentle slope inclined from the top to an inner flat surface of the upright portion on the side confronting the free end portion of the curved portion, and by forming both inner side surfaces of the upright portion which are located outward from the vicinity of a portion of the upright portion confronting the free end portion of the curved portion and which intersect with the inner flat surface of the upright portion, of gentle slopes inclined inwards toward each other and extending to the periphery of the inner surface, and desirably by making each of these three gentle slopes into a curved surface which is convex outward of the upright portion in the normal direction thereof.

BRIEF DESCRIPTION OF THE DRAWINGS

This and other features and advantages of the invention will become more apparent from the following detailed description taken in connection with the accompanying drawings in which.

DESCRIPTION OF THE SPECIFIC EMBODIMENT

Figure 1:
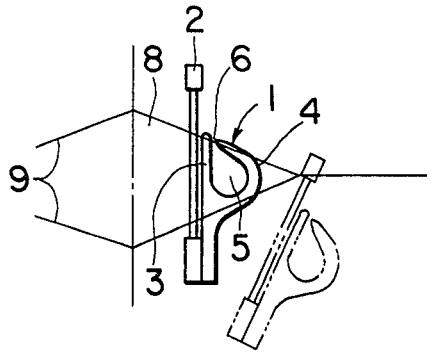
FIG. 1 is a schematic view of a part of an air jet shuttleless weaving loom including a weft yarn guide to which the invention is applied.

Referring to FIGS. 3 to 8 of the drawings, there is shown a weft yarn guide according to the invention. The weft yarn guide or guide member, generally designated by the reference numeral 20, comprises an upright or trunk portion 22, and a crescent or curved arm portion 24 which is branched off from a middle portion of the trunk portion 22 and is then curved toward an upper portion of the trunk portion 22. The trunk and curved portions 22 and 24 form therebetween a guiding aperture 26 in generally the form of a circle through which a jet of air entraining a weft yarn (not shown) is passed or guided for picking or insertion thereof. The curved portion 24 has a free end portion 28 confronting the upper portion of the trunk portion 22 and spaced from the trunk portion 22 by a suitable distance so as to form a gap 30 between the trunk and curved portions 22 and 24. The gap 30 provides communication between the aperture 26 and the outside thereof and functions as an exit or passage through which the weft yarn is permitted to slip out of the aperture 26 to the outside thereof when the guide 20 is taken out of the row of warp yarns 31 together with the movement of a reed (not shown) into its beat-up position after the weft yarn has been inserted and caught by weft catching means (not shown) such as warp yarns.

The trunk portion 22 has an extension which extends or projects beyond the top 32 of the free end portion 28 of the curved portion 24 and in the direction of the length of the trunk portion 22 as shown in the drawings. The guide 20 is improved in respect of the structure or form of an upper or outer portion 34 of the trunk portion 22 which is located outer from the vicinity of the portion of the trunk portion 22 which confronts the free end portion 28 of the curved portion 24.

Figure 2:
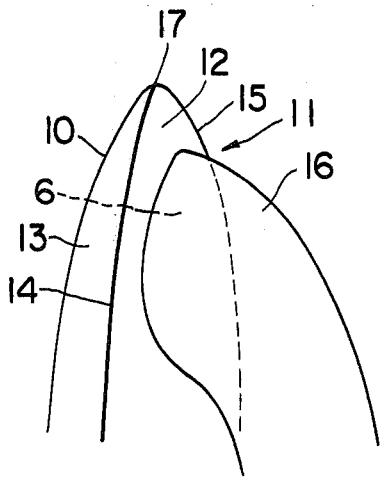
FIG. 2 is a schematic view of a part of a conventional weft yarn guide as per the introduction of the present specification.
Figure 6:
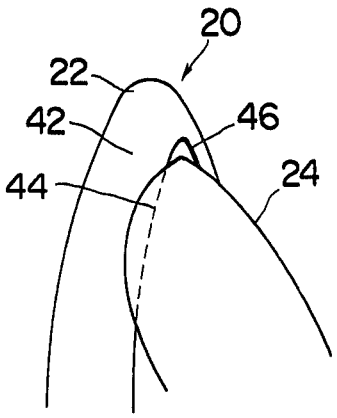
PRIOR ART FIG. 6
FIGS. 3 to 8 are schematic views of a preferred embodiment of a weft yarn guide according to the invention.
Figure 3:
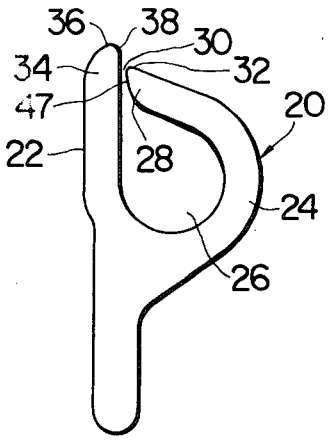
Figure 4:
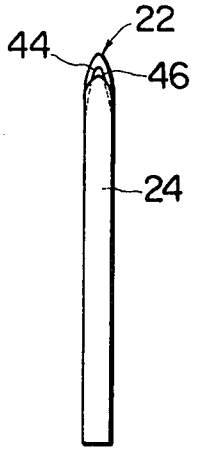
Figure 8:
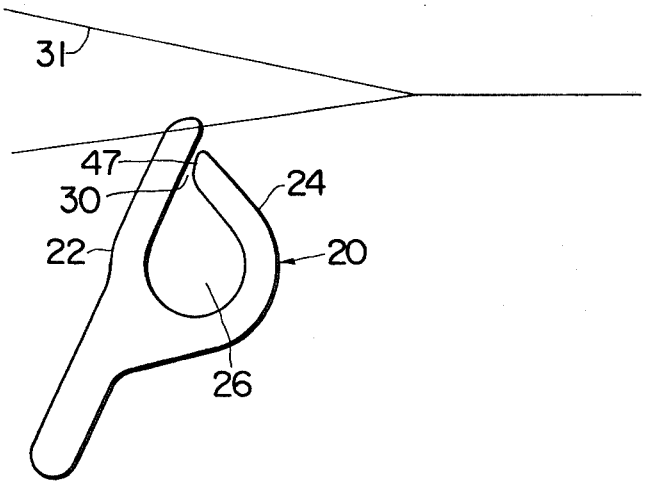

The upper portion 34 has a rounded apex 36 and a portion connected to the apex 36 and tapering to the apex 36 and having a gentle slope 38 which has a suitable width and is inclined from the top 36 to an inner flat surface 40 of the upper portion 34 on the side confronting the end portion 28 of the curved portion 24, as shown in FIGS. 3 and 6. As a result, the guide 20 is not provided with a pointed top as is the top 17 of the conventional weft yarn guide 1 shown in FIG. 2. Accordingly, the guide 20 can be smoothly inserted into the row of the warp yarns 31 without making the warp yarns 31 nappy or shaggy as shown in FIG. 8. It is desirable that the surface of the tapering portion including the slope 38 is a curved surface which is convex outward of the upper portion 34 in the normal direction thereof.

Figure 5:
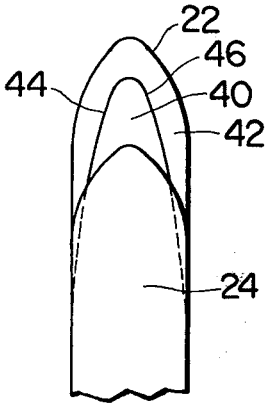
Figure 7:
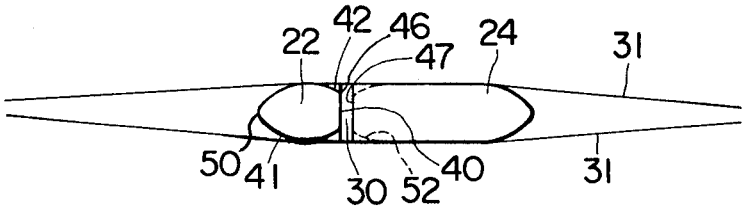

The upper portion 34 is further formed, at both side portions 41 thereof which intersect with the inner flat surface 40 of the upper portion 34 or at both portions thereof on the sides parallel with a plane including center lines of the trunk and curved portions 22 and 24, with gentle and arcuate side slopes 42 which are inclined inwards toward each other and extend to or are connected respectively with the edges of the inner flat surface 40, and are connected to each other as shown in FIGS. 6 and 7. Each of the slopes 42 has the same width as that of the slope 38 at the junction between the slopes 38 and 42 and is connected to the surface of the tapering portion. This results in making the distance between the junctions or corners 44 and 46 between the inner flat surface 40 and the slopes 42 or the width of the inner flat surface 40 in a direction perpendicular to the plane including the center lines of the trunk and curved portions 22 and 24 narrower than the maximum width of each of the trunk portion 22 and the flat end face 47 of the end portion 28 of the curved portion 24, as shown in FIGS. 5 and 6. As a result, the guide 20 is not formed at each of the corners or edges 44 and 46 of the inner flat surface 40 with a sharp corner having an acute angle but is formed, at each of the corners 44 and 46 of the surface 40 located inward of the maximum width of the end face of the curved portion 24, with a blunt corner having an obtuse angle. Accordingly, the corners 44 and 46 of the guide 20 are prevented from contacting with the warp yarns 31 as shown in FIG. 7 so that the warp yarns 31 are prevented from being made nappy or shaggy by the corners 44 and 46 when the guide 20 is put into and is taken out of the row of the warp yarns 31. It is desirable that each of the slopes 42 is a curved surface which is convex outward of the trunk portion 22 in the normal direction thereof. It is also desirable that the upper portion 34 is made smooth at the top 36, the surface of the tapering portion and the side slopes 42 and is rounded at the junction of the surface of the tapering portion and the side slopes 42 and at the junction 50 between the slopes 42 so that sharp peaks or seams are not formed at the upper portion 34, as shown in FIGS. 3 and 7.

It is further desirable that a side surface intersecting with the flat end face 47 of the curved portion 24 is formed of a gentle curved slope 52 which is convex outward of the curved portion 24 or the corner of the flat end face 47 is made round so that the warp yarns 31 are prevented from being made nappy or shaggy by the end portion 28 of the curved portion 24 when the guide 20 is inserted into the row of the warp yarns 31, as shown in FIG. 8.

It will be appreciated that the invention provides a weft yarn guide in which the trunk portion is formed, at the peripheral side of an inner surface thereof on the side confronting an end portion of the curved portion which surface is located outer than the end portion, with a convex curved surface gently inclined inward to the inner surface so that the corner of the inner surface is located inward of the outermost side surface of the trunk portion and the guide can be put into and taken out of the row of warp yarns without making the warp yarns nappy and scratching the warp yarns.

What is claimed is:

1. A weft yarn guide for an air jet shuttless weaving loom, comprising a trunk portion and a curved portion branched off from said trunk portion and then curved toward said trunk portion, said trunk and curved portions forming therebetween a guiding aperture through which a weft yarn is passed during insertion, said curved portion having an end portion confronting said trunk portion so that said trunk portion and said end portion defines therebetween a gap which provides communication between said aperture and the outside thereof and through which the weft yarn is passed from said aperture to the outside prior to beat-up, said trunk portion having an extension extending outer from the vicinity of a portion of said trunk portion which confronts said end portion of said curved portion, said extension having a rounded apex, a portion connected to said rounded apex and tapering to said rounded apex, and arcuate side slopes, said side slopes defining the surfaces of said extension on sides parallel with a plane including the respective center lines of said trunk and curved portions and of said extension, said side slopes being connected to the surface of said tapering portion and to each other and to an inner surface of said extension on a side thereof confronting said end portion, said side slopes being inclined inwards to said inner surface of said extension, said extension being rounded at a junction of said side slopes and at a junction of said surface of said tapering portion and said side slopes.

2. A weft yarn guide as claimed in claim 1, in which each of said surface of said taperting portion and said side slopes is a curved surface which is convex outward of said extension.

3. A weft yarn guide as claimed in claim 1, in which said inner surface has a width narrower than the maximum width of said end portion in a direction perpendicular to said plane including the center lines of said trunk and curved portions and of said extension.

4. A weft yarn guide as claimed in claim 1, in which said curved portion is formed at a peripheral edge of said end portion with a curved surface which is convex outward of said curved portion and is gently inclined inward to an end surface of said end portion.

* * * * *